US008078083B2

(12) United States Patent
Suzuki

(10) Patent No.: US 8,078,083 B2
(45) Date of Patent: Dec. 13, 2011

(54) IMAGE FORMING APPARATUS IN WHICH DEVELOPING UNIT IS EASILY DETACHABLE TO PHOTOSENSITIVE MEMBER UNIT

(75) Inventor: Tsutomu Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 740 days.

(21) Appl. No.: 11/736,842

(22) Filed: Apr. 18, 2007

(65) Prior Publication Data

US 2007/0242977 A1 Oct. 18, 2007

(30) Foreign Application Priority Data

Apr. 18, 2006 (JP) ..... 2006-114253

(51) Int. Cl.
*G03G 21/18* (2006.01)

(52) U.S. Cl. ..... 399/113

(58) Field of Classification Search ..... 399/107, 399/109–111, 113
See application file for complete search history.

(56) References Cited

U.S. PATENT DOCUMENTS

| | | | | |
|---|---|---|---|---|
| 5,027,152 | A | 6/1991 | Oda et al. | |
| 5,585,889 | A * | 12/1996 | Shishido et al. | 399/113 |
| 6,041,203 | A * | 3/2000 | Suzuki et al. | 399/111 |
| 6,101,350 | A | 8/2000 | Suzuki et al. | |
| 6,751,428 | B2 | 6/2004 | Okabe | |
| 2004/0165910 | A1 * | 8/2004 | Sato et al. | 399/116 |
| 2004/0179859 | A1 | 9/2004 | Ishii | |
| 2004/0265000 | A1 | 12/2004 | Okabe | |
| 2006/0083544 | A1 * | 4/2006 | Okabe | 399/111 |
| 2006/0083545 | A1 | 4/2006 | Okabe et al. | |

FOREIGN PATENT DOCUMENTS

| | | |
|---|---|---|
| JP | 3041477 | 2/1991 |
| JP | 2000250310 | 9/2000 |
| JP | 2003084645 | 3/2003 |
| JP | 2004279704 | 10/2004 |
| JP | 2005134483 | 5/2005 |
| JP | 2006119219 | 5/2006 |

* cited by examiner

*Primary Examiner* — David Porta
*Assistant Examiner* — Benjamin Schmitt
(74) *Attorney, Agent, or Firm* — Banner & Witcoff, Ltd

(57) ABSTRACT

An image forming device has a main casing, a first cartridge, and a second cartridge. The main casing has the image forming portion and an inner surface. The first cartridge is loadable to and unloadable from the image forming portion. The second cartridge detachably is attachable to the first cartridge. The first cartridge further has a receiving portion for receiving the second cartridge; and a first guide for guiding the second cartridge to the receiving portion. The main casing further has a second guide provided in the inner surface for guiding the second cartridge to the first cartridge loaded in the image forming portion. The second guide communicates with the first guide of the first cartridge loaded in the image forming portion.

18 Claims, 9 Drawing Sheets

IMAGE FORMING APPARATUS IN WHICH DEVELOPING UNIT IS EASILY DETACHABLE TO PHOTOSENSITIVE MEMBER UNIT

CROSS REFERENCE TO RELATED APPLICATIONS

This application claims priority from Japanese Patent Application No. 2006-114253 filed Apr. 18, 2006. The entire content of this priority application is incorporated herein by reference.

TECHNICAL FIELD

The present invention relates to an image forming apparatus including removable photosensitive member and developing cartridges, and more particularly to electrophotographic image forming apparatuses such as a laser printer, a copier, and a facsimile machine.

BACKGROUND

In the conventional image forming apparatus, a pair of guides are provided in a frame of the apparatus so as to guide the parts protruding outwardly from both left and right sides of the photosensitive member cartridge, i.e., rotation shaft of the photosensitive drum. Further, a pair of grooves are provided on the photosensitive member cartridge so as to guide the developing roller shaft of the developing cartridge into a unit accommodating part which accommodates the developing cartridge. In addition, Japanese Patent Application Publication No. 2003-84645 discloses an image forming apparatus which includes a developing cartridge removable without removing the photosensitive member cartridge from a frame.

In the above apparatus, a user is usually required to pay attention to attachment and detachment of the developing cartridge with respect to the photosensitive member cartridge.

An object of the present invention is to provide an image forming device in which a developing cartridge is easily attached to or detached from a photosensitive member cartridge loaded in a main casing.

SUMMARY

The present invention provides an image forming device having a main casing, a first cartridge, and a second cartridge. The main casing has the image forming portion and an inner surface. The first cartridge is loadable to and unloadable from the image forming portion. The second cartridge detachably is attachable to the first cartridge. The first cartridge further has a receiving portion for receiving the second cartridge; and a first guide for guiding the second cartridge to the receiving portion. The main casing further has a second guide provided in the inner surface for guiding the second cartridge to the first cartridge loaded in the image forming portion. The second guide communicates with the first guide of the first cartridge loaded in the image forming portion.

The present invention provides a primary cartridge loadable to and unloadable from an image forming portion in a main casing of an image forming device. The main casing has a primary guide for guiding a secondary cartridge to the primary cartridge loaded in the main casing. The secondary cartridge has a projection to be guided by the primary guide. The primary cartridge has a receiving portion and a secondary guide. The receiving portion receives a secondary cartridge. The secondary guide guides the secondary cartridge to the receiving portion by the projection. The primary guide is configured to connect with the secondary guide, when the secondary cartridge is loaded in the image forming portion.

The present invention provides a secondary cartridge detachably attachable to a primary cartridge loaded in an image forming portion in a main casing of an image forming device. The primary cartridge has a primary guide for guiding the secondary cartridge. The main casing has a secondary guide for guiding the secondary cartridge. The secondary cartridge has a casing and a projection. The casing has a side face. The projection is formed in an upper portion of the side face. The projection is configured to be guided by the primary guide and the secondary guide to a predetermined position in the image forming portion.

BRIEF DESCRIPTION OF THE DRAWINGS

Illustrative aspects in accordance with the invention will be described in detail with reference to the following figures wherein.

DETAILED DESCRIPTION

Hereinafter, embodiments of the present invention will be described with reference to the accompanying drawings. In the following description, the expressions "front", "rear", "above", "below", "right", and "left", are used throughout the description to define the various parts when a laser printer and a process cartridge are disposed in an orientation in which the laser printer and the process cartridge are intended to be used.

Figure 1A:
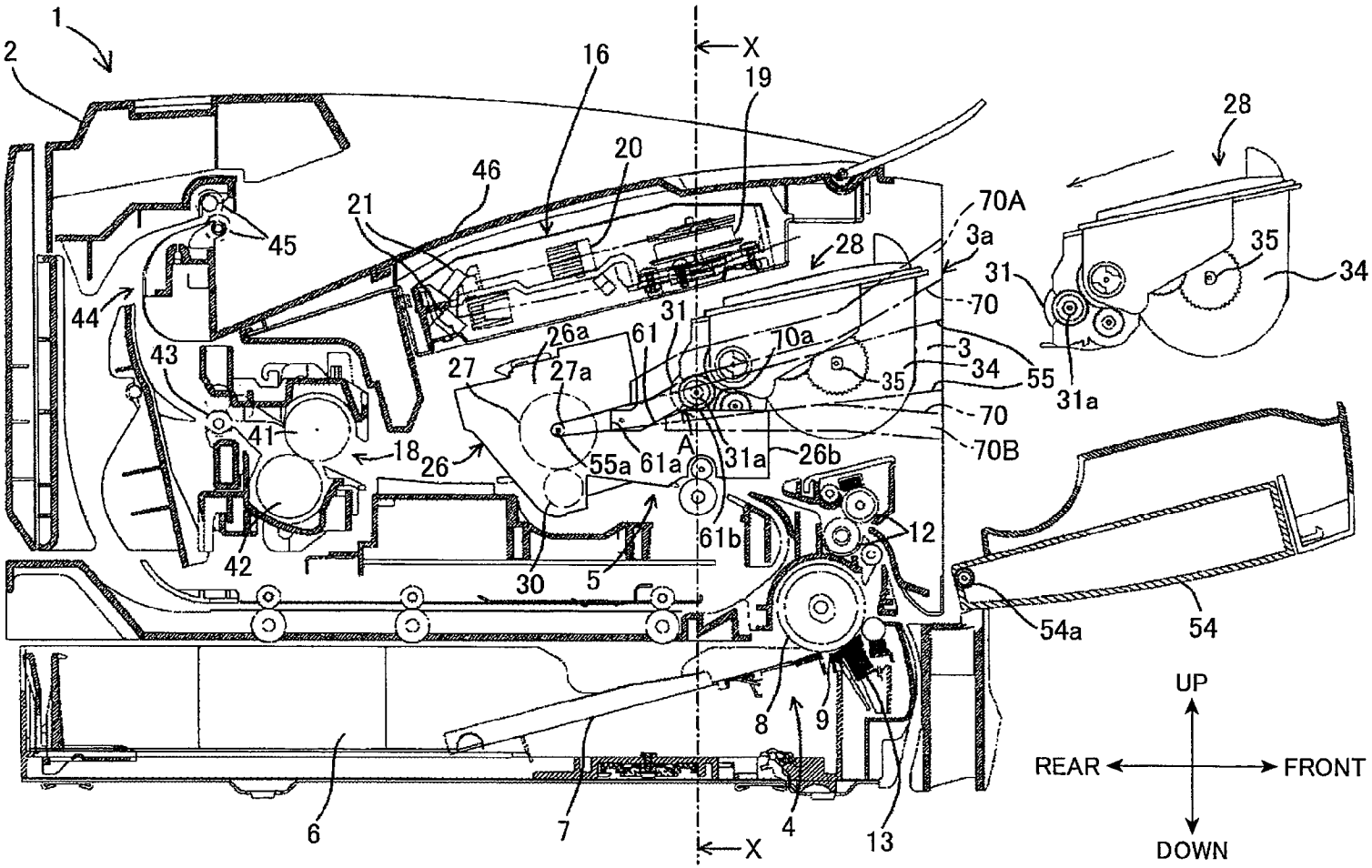
FIG. 1A is a side cross-sectional view showing a laser printer according to a first embodiment of the present invention.

Referring to FIG. 1A, a laser printer 1 includes a main casing 2 having a feeder unit 4 which feeds a sheet of paper as a recording medium and an image forming unit 5 which forms a given image on the fed paper sheet.

The feeder unit 4 includes a paper tray 6 removably attached to the bottom of the main casing 2, a paper mounting plate 7 provided in the paper tray 6, a feed roller 8 and a feed pad 9 provided at an upper end of the paper tray 6, and a pair of register rollers 12 provided downstream of the feed roller 8 in the sheet feeding direction.

The paper mounting plate 7 supports a stack of paper sheets. The paper mounting plate 7 pivots about one end far from the feed roller 8 so that the closer end is vertically movable. The paper mounting plate 7 is urged upwardly by a spring (not shown) disposed on the underside of the paper mounting plate 7. As the amount of the paper sheets stacked on the paper mounting plate 7 increases, the paper mounting plate 7 pivots downward about the one end away from the feed roller 8 against an urging force of the spring. The feed roller 8 and the feed pad 9 are arranged to face each other. The feed pad 9 is pressed against the feed roller 8 by a spring 13 disposed on the underside of the feed pad 9. The sheet stack on the paper stack on the paper mounting plate 7 is urged toward the feed roller 8 by a spring (not shown) disposed on the underside of the paper mounting plate 7 so that a topmost sheet can be pinched between the feed roller 8 and the feed pad 9 as the feed roller 8 rotates, thereby feeding each topmost sheet. The fed sheet is then sent to the register rollers 12. The register rollers 12 register the sheet for correcting its orientation and then feed the sheet to the image forming unit 5.

The image forming unit 5 includes a scanner unit 16, a process cartridge 17, and a fixing unit 18.

The scanner unit 16 is provided in an upper portion of the main casing 2 below the underside of a discharge tray 46. The scanner unit 16 includes a laser unit (not shown), a polygon mirror 19 rotatably driven, lens 20, and a reflecting mirror 21. A beam of laser light based on given image data emitted from the laser unit passes through or reflects at the polygon mirror 19, the lens 20, and the reflecting mirror 21 in this order as indicated by a chain line, to scan at high speed across a surface of a photosensitive drum (photosensitive member) 27 in the process cartridge 17.

Figure 1B:
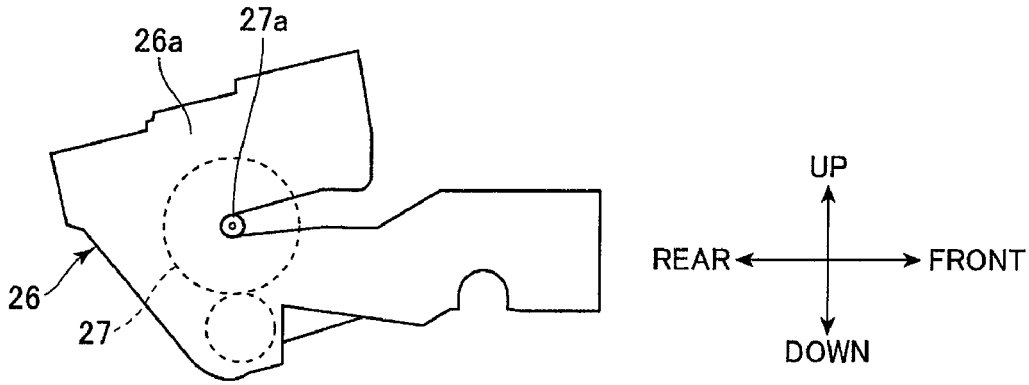
FIG. 1B is a side view showing a photosensitive member cartridge shown in FIG. 1A.

As shown in FIG. 1A, the process cartridge 17 includes a photosensitive member cartridge 26 and a developing cartridge 28 attached thereto. The photosensitive member cartridge 26 includes the photosensitive drum 27, a scorotron charger (not shown), and a transfer roller 30, as shown in FIG. 1B.

In a state where the developing cartridge 28 is attached to the photosensitive member cartridge 26, the photosensitive drum 27 is rotatably provided to a side of a developing roller 31 so as to face the developing roller 31. The photosensitive drum 27 includes a grounded drum body, and the surface of the photosensitive drum 27 is formed of a positively-chargeable photosensitive layer made from a variety of materials. Examples thereof include an amorphous silicon-based material such as α-Si:H, a cadmium sulfide-based material such as CdS, a zinc oxide-based material such as ZnO, a selenium-based material such as AsSe3, and an organic photoreceptor material such as polycarbonate.

A rotation shaft 27*a* of the photosensitive drum 27 protrudes from both right and left sides of the photosensitive member cartridge 26, and the photosensitive drum 27 is rotatably driven by a driving force transmitted from a main motor (not shown).

The scorotron charger (not shown) is disposed above the photosensitive drum 27 with a predetermined distance therefrom so as not to make contact with the photosensitive drum 27. The scorotron charger is a positively charging charger which generates corona discharge from a charging wire made from tungsten or other material for uniformly and positively charging the surface of the photosensitive drum 27. As the photosensitive drum 27 rotates, the surface of the photosensitive drum 27 is first uniformly and positively charged by the scorotron charger, and then exposed to the laser light emitted from the scanner unit 16 by high-speed scanning based on image data so as to form an electrostatic latent image on the surface of the photosensitive drum 27.

Below the photosensitive drum 27, the transfer roller 30 is rotatably supported so as to face the photosensitive drum 27. The transfer roller 30 includes a metal roller shaft covered by a roller portion formed of an ion-conductive rubber material. A transfer bias (forward bias) is applied from a transfer bias applying power source to the transfer roller 30 for transfer. Accordingly, a visible image is formed on the surface of the photosensitive drum 27, and the visible image is transferred onto a paper sheet while the sheet passes between the photosensitive drum 27 and the transfer roller 30.

The developing cartridge 28 shown in FIG. 1A is detachably attached to the photosensitive member cartridge 26. The developing cartridge 28 includes the developing roller 31, a layer thickness regulating blade 32 (not shown in FIG. 1A), a toner supply roller 33 (not shown in FIG. 1A), and a toner box 34.

The toner box 34 accommodates a positively chargeable non-magnetic single component toner, as a developing agent. The toner is, for example, a polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1-C4) acrylate, and alkyl (C1-C4) methacrylate. Polymerized toner particles are spherical in shape, and thus have excellent fluidity. A coloring material such as carbon black and wax are added to the toner. In order to improve the fluidity of the toner, silica is also added to the toner as an external additive. A toner particle size is approximately 6 to 10 μm.

An agitator shaft 35 is disposed in a substantially central portion of the toner box 34. The agitator shaft 35 supports an agitator (not shown) which agitates the toner in the toner box 34 as the agitator rotates. The toner is discharged through a toner supply opening (not shown) provided in a side wall of the toner box 34.

The toner supply roller 33 is disposed to a side of the toner supply opening. The developing roller 31 is rotatably disposed at a position in confrontation with the toner supply roller 33. The toner supply roller 33 and the developing roller 31 are in pressure contact with each other. The toner supply roller 33 includes a metal roller shaft covered by a roller portion formed of an electrically conductive foam material.

The developing roller 31 includes a metal roller shaft 31*a* covered by a roller portion formed of an electrically conductive rubber material. More specifically, the roller portion of the developing roller 31 is formed of an electrically conductive urethane rubber or silicone rubber including fine carbon particles. A surface of the roller portion of the developing roller 31 is coated with urethane rubber or silicone rubber those including fluorine. A developing bias is applied to the developing roller 31 from a developing bias application power source (not shown).

The toner layer thickness regulating blade 32 is disposed adjacent to the developing roller 31. The regulating blade 32 includes a blade portion formed of a leaf spring and a contact portion attached to one end of the blade portion. The contact portion has a semicircular cross-sectional shape, and is formed of insulating silicone rubber. The toner layer thickness regulating blade 32 is supported near the developing roller 31 to the developing cartridge 28 so that the contact portion presses the developing roller 31 with the resiliency of the blade portion.

The toner discharged through the toner supply opening is supplied onto the developing roller 31 by the rotation of the toner supply roller 33. At this time, the toner is positively charged through friction charging at a contact portion between the toner supply roller 33 and the developing roller 31. As the developing roller 31 rotates, the toner supplied onto the developing roller 31 enters between the contact portion of the layer thickness regulating blade 32 and the developing roller 31, where the toner is again charged through friction charging more sufficiently. The toner which has passed between the contact portion and the developing roller 31, is formed into a thin toner layer having a uniform thickness on the developing roller 31.

Thereafter, in accordance with the rotation of the developing roller 31, the toner carried on the developing roller 31 and charged with positive polarity is deposited onto the electrostatic latent image formed on the photosensitive drum 27, when making contact with the photosensitive drum 27 from the front. In other words, the toner is selectively supplied to parts on the surface of the photosensitive drum 27 exposed to the laser light, where the potential level is lower than that of the remaining part of the photosensitive drum surface uniformly positively charged. Thus, a visible toner image is formed in a reversed manner.

The fixing unit 18 is disposed downstream of the process cartridge 17 in the sheet feeding direction. The fixing unit 18 includes a heat roller 41, a pressure roller 42 that is pressed against the heat roller 41, and a feeding roller 43 disposed downstream of the heat roller 41 and the pressure roller 42 in the sheet feeding direction. The heat roller 41, formed of metal, includes a halogen lamp as a heat source. When the toner which has transferred on the sheet in the process cartridge 17 passes between the heat roller 41 and the pressure roller 42, the toner is fused by heat to fixedly adhere to the sheet. After that, the sheet is transported by the feeding roller 43, to a discharge path 44. The sheet fed to discharge rollers 45 is discharged onto the discharge tray 46 through the discharge path 44 by the discharge rollers 45.

Referring to FIG. 1A, the laser printer 1 includes a structure for detachably loading the photosensitive member cartridge 26 to the main casing 2.

A front cover 54 rotatable about a supporting shaft 54*a* is disposed on the front surface of the main casing 2 to open and close the main casing 2. When the front cover 54 is in an open position, an internal space 3 is provided in the main casing 2 so as to insert the photosensitive member cartridge 26 and the developing cartridge 28 therethrough. As shown in FIG. 1A, in the space for attachment 3, a pair of photosensitive member cartridge guides 55 (indicated by the alternate long and short dashed line in FIG. 1A) is formed to extend downward from a starting portion 3*a* to the position for the photosensitive member cartridge 26 in FIG. 1A. Each of the photosensitive member cartridge guides 55 is formed as a substantially V-shaped groove having a tapered width to an insertion stop position 55*a* in order to guide the rotating shaft 27*a* of the photosensitive drum 27 between the upper and lower portions of the guide 55. It is noted that the rotating shaft 27*a* of the photosensitive drum 27 protrudes from the right and left sides of the photosensitive member cartridge 26. The rotating shaft 27*a* is positioned so as to be rotatably supported at the lower end of each guide groove, i.e., the insertion stop position 55*a*.

The photosensitive member cartridge 26 includes a handle (not shown) provided on and above an end plate 26*b* thereof. The developing cartridge 28 includes a handle (not shown) provided on an opposite side portion to the side portion facing the developing roller 31. The handle of the photosensitive member cartridge 26 is provided at the position for staying away from the side end of the developing roller 30 in the developing cartridge 28, when the developing cartridge 28 is loaded to the developing member cartridge 26.

In the structure described above, by holding the handle (not shown) of the photosensitive member cartridge 26, the left and right side ends of the rotating shaft 27*a* are inserted in the guide grooves 55 with the photosensitive drum 27 side of the photosensitive member cartridge 26 facing the internal space 3. The photosensitive member cartridge 26 is then loaded into the position where the rotating shaft 27*a* is supported at the insertion stop position 55*a* along the photosensitive member cartridge guides 55, and then disposed at the image forming position with stability. On the other hand, when the photosensitive member cartridge 26 is unloaded from the image forming position, by pulling the handle (not shown), the photosensitive member cartridge 26 is guided and unloaded obliquely upward with the front portion of the photosensitive member cartridge 26 up. The guides 55 are available to the process cartridge 17 in which the developing cartridge 28 has been assembled to the photosensitive member cartridge 26 for loading and unloading the process cartridge 17 to and from the main casing 2, respectively. When the handle of the developing cartridge 28 is merely operated, the process cartridge 17 is easy to be loaded and unloaded. It should be noted that Japanese Patent Application Publication No. 2000-250310 discloses that each of the photosensitive member cartridge 26 and the developing cartridge 28 is loaded in and unloaded from the main casing 2 alone.

The next description will explain the structure for allowing the developing cartridge 28 to be detachably loaded to the photosensitive member cartridge 26 disposed at the image forming position. Referring first to FIG. 1A, the structure of the photosensitive member cartridge 26 is described as follows.

The photosensitive member cartridge 26 includes left and right side plates 26*a* and 26*a*. The rotating shaft 27*a* of the photosensitive drum 27 projects from the side plates 26*a* and 26*a* at the downstream positions in the loading direction of the photosensitive member cartridge 26 into the main casing 2. Upstream portions of left and right side plates 26*a* and 26*a* in the loading direction, and an end plate 26*b* provides an accommodation site for accommodating the developing cartridge 28 therein. Each of the left and right side plates 26*a* and 26*a* of the photosensitive member cartridge 26 has a developing cartridge guide 61 extending toward the photosensitive drum 27. In this embodiment, the developing cartridge guide 61 is formed as a longitudinal notch in each of the side plates 26*a* and 26*a*. The shape of the developing cartridge guide 61 is identical to the shape of the bottom portion of the photosensitive member cartridge guide 55, as shown in FIG. 1A.

Figure 2A:
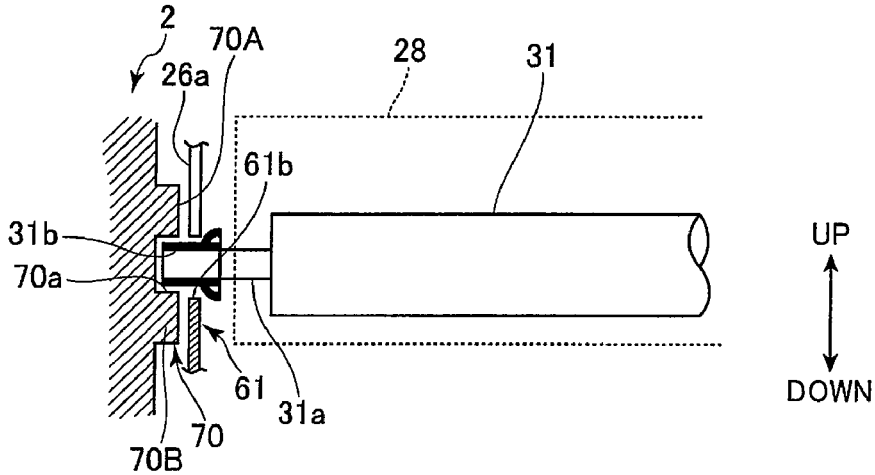
FIGS. 2A-2D show a guide for a developing cartridge, respectively.

When the developing cartridge 28 is to be loaded to the accommodating site with the developing roller 31 facing the internal space 3, the roller shaft 31*a* protruding from both right and left sides of the developing roller 31 slides along the photosensitive member cartridge guide 61 of each of the left and right side plates 26*a* and 26*a* into the position where the developing roller 31 contacts with the photosensitive drum 27 (the trailing end 61*a* of the photosensitive member cartridge guide 61). In this state, the developing cartridge 28 is supported by the photosensitive member cartridge 26 with stability. The roller shaft 31*a* includes a collar member 31*b* fitted to both ends thereof, as shown in FIG. 2A. In this embodiment, the length of the roller shaft 31*a* of the developing roller 31 is shorter than the length of the rotating shaft 27*a* of the photosensitive drum 27.

As shown in FIG. 1A, the main casing 2 includes a second developing cartridge guide 70 which communicates with the photosensitive member cartridge guide 61 of the photosensitive member cartridge 26. The second developing cartridge guide 70 includes two substantially linear projection guides 70A, 70B projecting from an internal side face of the main casing 2 in an axial direction of the developing roller 31. The projection guides 70A, 70B are positioned in parallel to each other in a vertical direction. In particular, an lower face of the projection guide 70A and an upper face of the projection guide 70B define the developing cartridge guide 70 to guide the developing cartridge 28 to the photosensitive member cartridge 26.

The second developing cartridge guide 70 extends on an inner side of the main casing 2 to connect the starting portion 3*a* of the internal space 3 to the photosensitive member cartridge guide 61 of the photosensitive member cartridge 26 which has been disposed at the image forming position. The vertical distance between the linear projection guides 70A, 70B is the largest at the starting portion 3*a*, and gradually decreases from the starting portion 3*a* to the image forming position.

In this embodiment, the second developing cartridge guide 70 has two projection guides 70A, 70B. When the developing cartridge 28 is loaded into the main casing 2, the upper surface of the lower projection guide 70B may be used for guiding the developing cartridge 26 thereon, or the lower surface of the upper projection guide 70A may be used for guiding the developing cartridge 26 thereon. This structure of the second developing cartridge guide 70 is advantageous to a user, because the user can select either one of the projection guides 70A and 70B which is used for guiding the developing cartridge 26, depending on the height at which the laser printer 1 is placed. This facilitates the user's loading operation of the developing cartridge 26. In another embodiment, the second developing cartridge guide 70 may include only one linear projection guide 70B.

In order to load the developing cartridge 28 into the accommodating site of the photosensitive member cartridge 26 disposed at the image forming position, the roller shaft 31*a* protruding from both right and left sides of the developing roller 31 slides along the developing cartridge guide 70. As described above, since the developing cartridge guide 70 has a large width at the starting point 3*a*, the roller shaft 31*a* of the developing roller 31 is easily put into the developing cartridge guide 70. FIG. 2A is a cross-sectional view taken along lines X-X of FIG. 1A, showing the roller shaft 31*a* of the developing cartridge 28 arrives at the position shown in FIG. 1A. In this embodiment, the lower guide surface 70*a* of the lower projection guide 70B, which slidably contacts with the lower sliding surface of the roller shaft 31*a*, is positioned slightly above an upstream guide surface 61*b* of the photosensitive member cartridge guide 61 in the loading direction of the developing cartridge 28, as viewed from a side. The lower guide surface 70*a* of the lower projection guide 70B comes to be positioned at the same height at the height of the photosensitive member cartridge 61 at the position A which is closer to the photosensitive member cartridge 26 from the position X of FIG. 1A by a short distance.

When the roller shaft 31*a* which has been guided by the developing cartridge guide 70 arrives at the position A shown in FIG. 1A, the photosensitive member cartridge guide 61 of the photosensitive member cartridge 26 then guides the roller shaft 31*a*. The projection guide 70B is terminated at the position closer to the photosensitive member cartridge 26 than the position at which the guide of the developing cartridge 28 is switched from the second developing cartridge guide 70 to the first developing cartridge guide 61. When the roller shaft 31*a* slides along the photosensitive member cartridge guide 61 formed in the left and right side plates 26*a* and 26*a* of the photosensitive member cartridge 26 and arrives at the trailing end 61*a* of the photosensitive member cartridge guide 61, the roller shaft 31*a* is rotatably supported by the photosensitive member cartridge 26.

Figure 3:
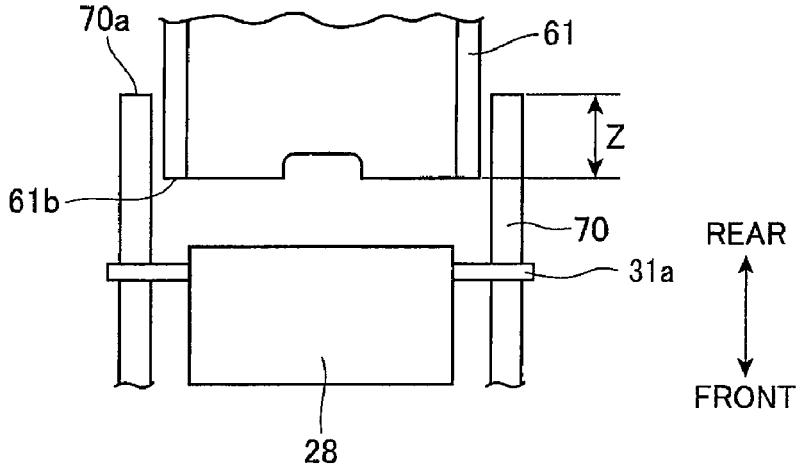
FIG. 3 is a plan view explaining an overlapping zone Z.

FIG. 3 shows a scheme that the roller shaft 31*a* of the developing cartridge 28 is first guided by the second developing cartridge guide 70, and then guided by the first photosensitive member cartridge guide 61, with emphasis for understanding.

As is clear from FIG. 3, in a section Z, the first photosensitive member cartridge guide 61 and the second developing cartridge guide 70 are positioned parallel to each other from the above. Specifically, the upstream guide surface 61*b* of the photosensitive member cartridge guide 61 and the downstream section of the lower guide surface 70*a* of the developing cartridge guide 70 overlap each other over a certain length in the attaching direction of the developing cartridge 28 as viewed from a side. In this section Z, the lower peripheral surface of the roller shaft 31*a* is guided by the second developing cartridge guide 70 and the first developing cartridge guide 61.

In another embodiment, the first developing cartridge guide 61 may be aligned with the second developing cartridge guide 70. In this case, the first developing cartridge guide 61 may be connected to the second developing cartridge guide 70 without any gap therebetween. Alternatively, the first developing cartridge guide 61 may be connected to the second developing cartridge guide 70 through a gap which is less than a diameter of the roller shaft 31*a*.

Referring now to FIG. 2, the next description will explain a laser printer of a second embodiment. The second embodiment is different from the first embodiment in that the photosensitive member cartridge guide serves as the developing cartridge guide. In this embodiment, a combination guide 56 is formed in an inner side surface of the main casing 2 to function as both of the photosensitive member cartridge guide and the developing cartridge guide. The structural member which has a same function as that of the first embodiment has the same reference number. And detailed description thereof is omitted here.

Figure 4:
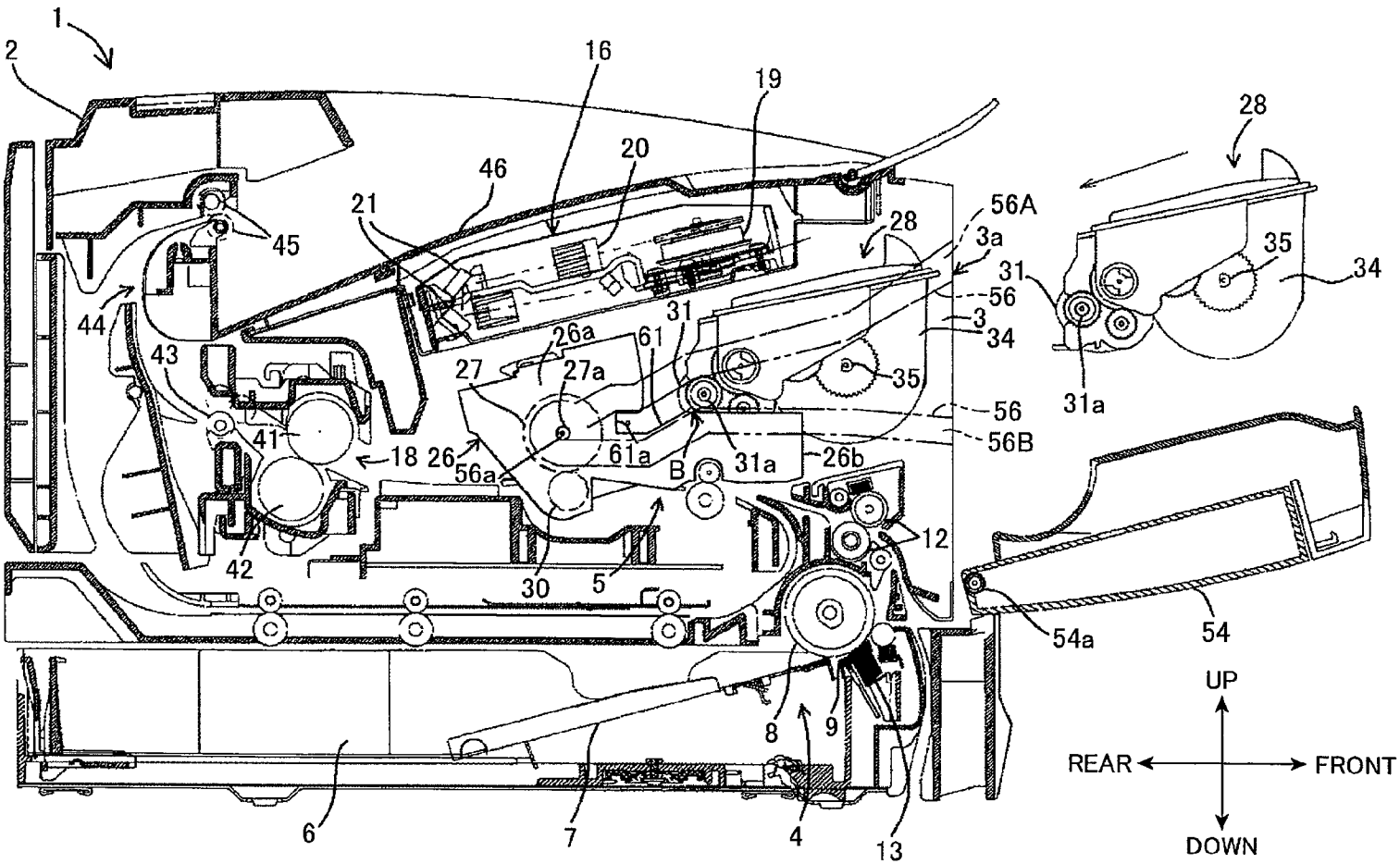
FIG. 4 is a side cross-sectional view showing a laser printer according to a second embodiment.

As shown in FIG. 4, a pair of combination guides 56 are formed on the left and right inner side surfaces of the internal space 3 to slant downward from a starting portion 3*a*. Each of the combination guides 56 is provided by an upper projection guide 56A having a lower surface, and a lower projection guide 56B having an upper surface. The upper projection guide 56A and the lower projection guide 56B are positioned to sandwich the rotation shaft 27*a* of the photosensitive drum 27 from above and below, thereby forming a substantially U-shaped groove in the inner side surface of the internal space 3. The photosensitive drum 27 is rotatably supported through the rotation shaft 27*a* at the rearmost end of the combination guide 56, i.e., insertion stop position 56*a*.

In the structure described above, by gripping the handle (not shown) of the photosensitive member cartridge 26, the left and right side ends of the rotating shaft 27*a* are inserted into the guide grooves 55, with the photosensitive drum 27 side of the photosensitive member cartridge 26 facing the internal space 3. The photosensitive member cartridge 26 is then loaded along the photosensitive member cartridge guide 56 to the position where the rotating shaft 27*a* is rotatably supported at the insertion stop position 56*a*, and disposed at the image forming position with stability. The way to unload the photosensitive member cartridge 26 from the image forming position is the same as that of the first embodiment.

The Next description will explain the structure which enables the developing cartridge 28 to be detachably attached to the photosensitive member cartridge 26 disposed at the image forming position.

The combination guides 56 are formed in the inner side surfaces of the main casing 2 to function as the photosensitive member cartridge guide and the developing cartridge guide. The roller shaft 31*a* is guided from the starting portion 3*a* of the internal space 3 by the combination guides 56 so that the developing cartridge 28 is loaded in the main casing 2. When the roller shaft 31*a* arrives at the position B shown in FIG. 4, the roller shaft 31*a* is then guided by the photosensitive member cartridge guide 61 of the photosensitive member cartridge 26. The roller shaft 31*a* then slides along the photosensitive member cartridge guide 61. When the roller shaft 31*a* arrives at the trailing end 61*a* of the photosensitive member cartridge guide 61, the roller shaft 31*a* is rotatably supported by the photosensitive member cartridge 26.

Described above, since the combination guides 56 functions as both of the photosensitive member cartridge guide and the developing cartridge guide, the internal structure of the main casing 2 is made simple. And this structure facilitates the loading of both of the photosensitive member cartridge 26 and the developing cartridge 28 to the main casing 2.

Figure 5A:
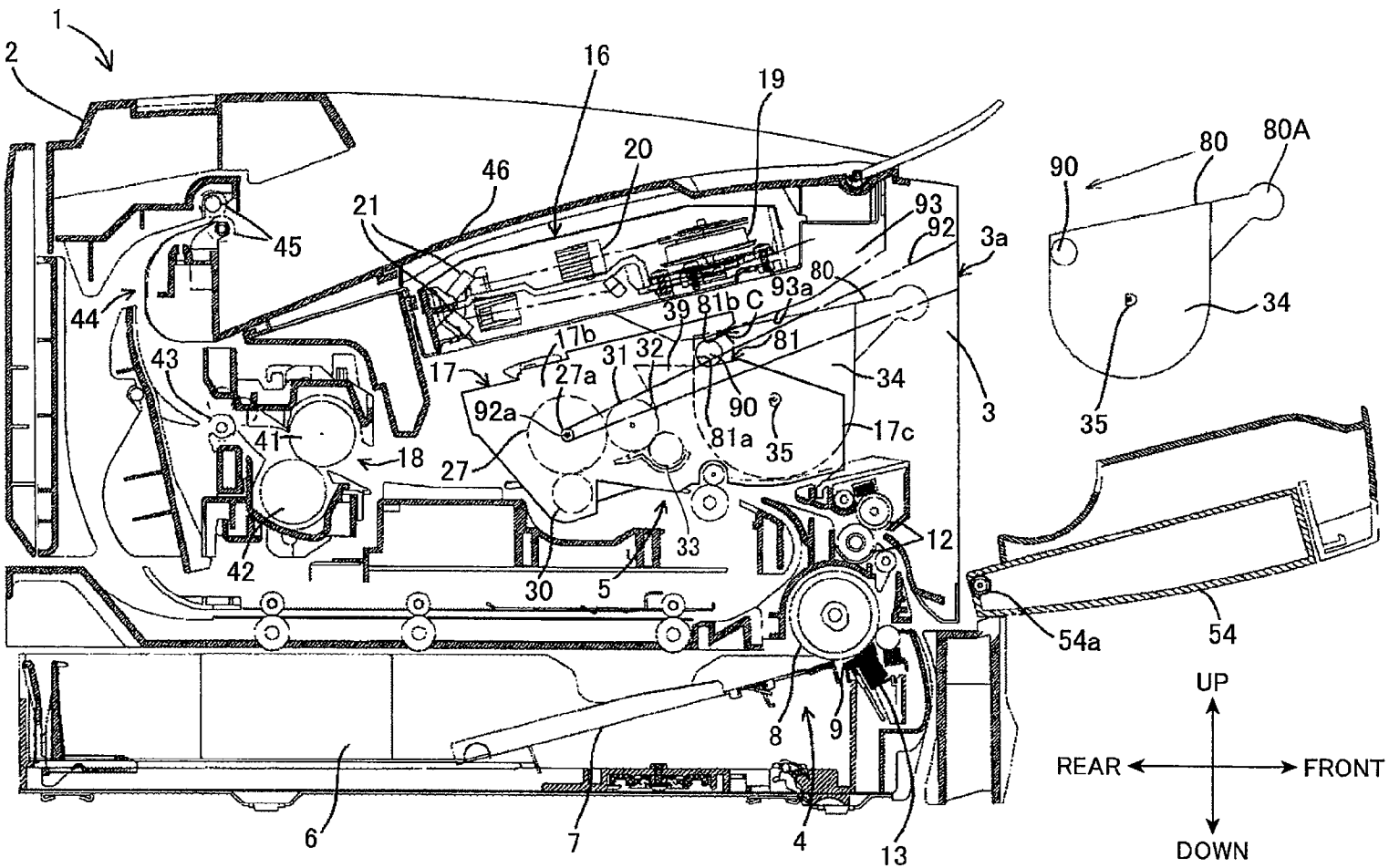
FIG. 5A is a side cross-sectional view showing a laser printer according to a third embodiment.
Figure 5B:
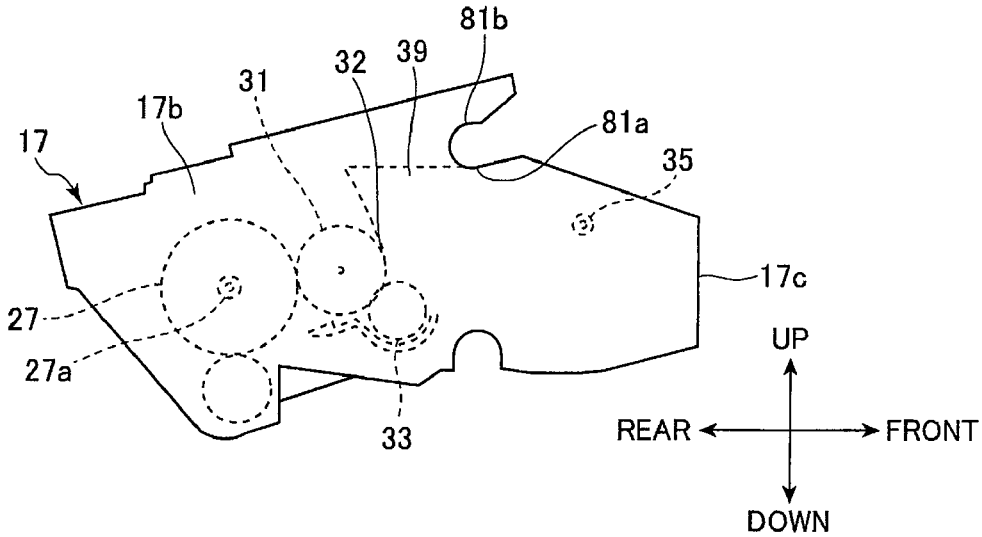
FIG. 5B is a side view showing a process cartridge shown in FIG. 5A.

Referring to FIG. 5A, the next description will explain a laser printer 1 of a third embodiment. In this embodiment, the process cartridge 17 includes a photosensitive drum 27, a developing roller 31, a layer thickness regulating blade 32, a supply roller 33, a scorotron charger (not shown), and a transfer roller 30, as shown in FIG. 5B. A toner cartridge 80 including a toner box 34 for accommodating a developing agent is detachably attached to the process cartridge 17.

In FIGS. 5A and 5B, the process cartridge 17 is formed as a single unit. In another embodiment, the process cartridge 17 may be formed by combining a photosensitive member cartridge including at least a photosensitive drum 27, and a developing cartridge including at least a developing roller 31. In this case, the photosensitive member cartridge and the developing cartridge may be combined by using a well-known manner.

The next description will explain the structure which enables the toner cartridge 80 to be attached to the process cartridge 17.

The rotation shaft 27*a* of the photosensitive drum 27 projects from the downstream positions of the left and right side plates 17*b* and 17*b* of the process cartridge 17 in the loading direction to the main casing 2. Frontward portions of the left and right side plates 17*b* and 17*b* and an end plate 17*c* positioned at the trailing end in the insertion direction define an accommodation site for accommodating the toner cartridge 80. The left and right side plates 17*b* and 17*b* of the accommodation site has toner cartridge guides 81. The process cartridge 17 has an opening (not shown) on the trailing end through which toner is supplied. When the toner cartridge 80 is attached to the process cartridge 17, a toner supply opening (not shown) formed in the leading end of the toner cartridge 80 communicates with the opening.

The toner cartridge 80 includes an agitator (not shown). The toner is agitated in the toner box 34, as the agitator rotates. The toner is discharged from the toner supply opening (not shown) to a processing chamber 39 in the process cartridge 17. An agitator shaft 35 is rotatably provided in a substantially central portion of the toner box 34. A toner cartridge protrusion 90 is provided in both sides of the toner box 34 and downstream of the agitator shaft 35 in the attaching direction. The toner cartridge protrusion 90 is provided in an upper portion of the toner cartridge 80 and on the opposite side to a handle 80A thereof.

Figure 8A:
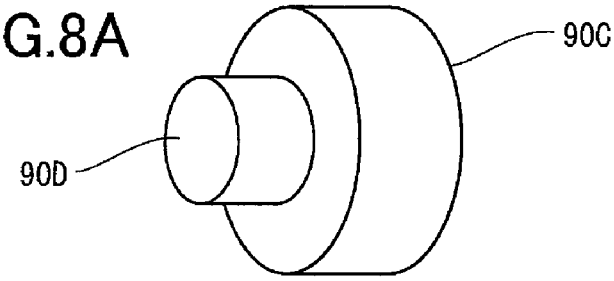
FIGS. 8A-8D are perspective views showing modifications of toner unit protrusion.
Figure 8B:
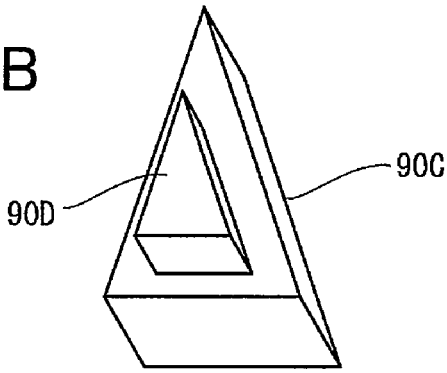
Figure 8C:
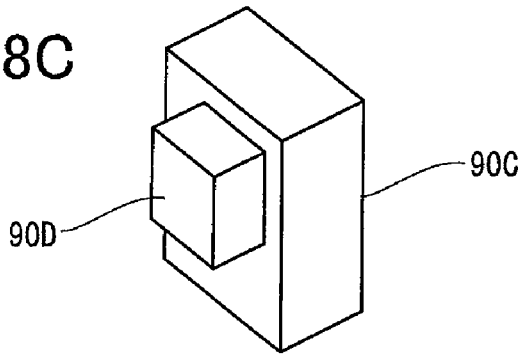
Figure 8D:
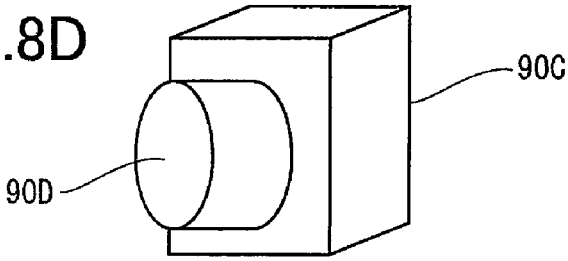

The toner cartridge protrusion 90 has two-level stepped shape, as shown in FIGS. 8A-8D. The toner cartridge protrusion 90 has a smaller cross section portion at the distal end and a larger cross section portion at the proximal end. FIG. 8A shows the toner cartridge protrusion 90 in which two different diameter cylinders are stacked. FIG. 8B shows the toner cartridge protrusion 90 in which two different triangular prisms are stacked. FIG. 8C shows the toner cartridge protrusion 90 in which two different quadrangular prisms are stacked. FIG. 8D shows the toner cartridge protrusion 90 in which a cylinder having a smaller cross section is stacked on a quadrangular prism having a larger cross section. With the above structures of the toner cartridge protrusion 90, the larger cross section portion at the proximal end is guided along the toner cartridge guide 81. The smaller cross portion at the distal end is guided along a toner cartridge guide 93.

The toner cartridge 80 is loaded to the process cartridge 17 with the toner cartridge protrusion 90 being oriented toward the internal space 3. The toner cartridge protrusion 90 slides along the toner cartridge guide 81 of the left and right side plates 17*b* and 17*b*. When the toner cartridge protrusion 90 arrives at the trailing end 81*a* of the guide on the toner cartridge side 81, the toner cartridge 80 is supported by the process cartridge 17 with stability.

The next description will explain the structure which enables the process cartridge 17 to be loaded to the main casing 2.

As shown in FIG. 5A, in the internal space 3, a pair of process cartridge guides 92 (indicated by the alternate long and short dashed line in FIG. 5A) is formed in the left and right sides of the internal space 3 to slant downward from a starting portion 3*a* to an image forming position. The process cartridge guides 92 are formed as a substantially U-shaped groove as viewed from a side to sandwich the rotating shaft 27*a* of the photosensitive drum 27 from above and below. The rotating shaft 27*a* is rotatably supported at the lower end of the grooves, i.e., an insertion stop position 92*a*.

In the structure described above, by holding a handle (a portion of the end plate 17*c*) of the process cartridge 17, the left and right side ends of the rotating shaft 27*a* are inserted into the process cartridge guide 92 with the photosensitive drum 27 side of the process cartridge 17 facing the internal space 3. The process cartridge 17 is then guided to the position where the rotating shaft 27*a* is supported at the insertion stop position 92*a* of the process cartridge guide 92, and disposed at the image forming position with stability. On the other hand, in order to unload the process cartridge 17 from the mage forming position, by holding the handle (not shown) of the process cartridge 17 up, the process cartridge 17 is pulled out obliquely upward with the front end thereof being oriented upward. The above way to load and unload the process cartridge 17 in the main casing 2 is also available to the loading of the processing cartridge 17, which the toner cartridge 80 has been attached to the process cartridge 17, to the main casing 2.

The next description will explain the structure which enables the toner cartridge 80 to be detachably loaded to the process cartridge 17 disposed at the image forming position.

As shown in FIG. 5A, the main casing 2 includes toner cartridge guides 93 formed in the left and right inner side faces of the internal space 3 to communicate with the toner cartridge guide 81 of the process cartridge 17. The toner cartridge guide 93 extends on the inner surface of the main casing 2 to connect a starting portion 3*a* of the internal space 3 to the toner cartridge guide 81 of the process cartridge 17 disposed at the image forming position.

In order to load the toner cartridge 80 in the accommodation site of the process cartridge 17 disposed at the image forming position, the toner cartridge protrusion 90 is guided with the upper outer circumference surface thereof contacting the toner cartridge guide 93. As described above, since the toner cartridge guide 93 extends from the starting portion 3*a* of the internal space 3, the toner cartridge 93 guide is easily recognized when the front cover 54 is open. Therefore, it is easy to load the toner cartridge 80 from the starting portion 3*a*.

Figure 6A:
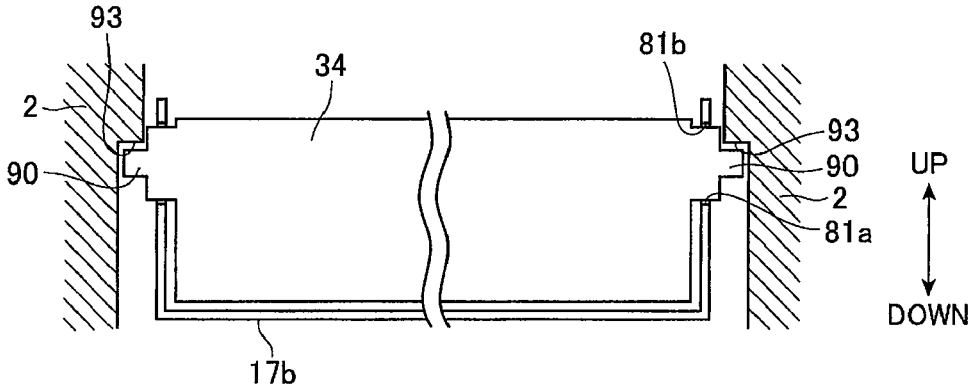
FIGS. 6A-6D show a guide for a toner cartridge, respectively.
Figure 6B:
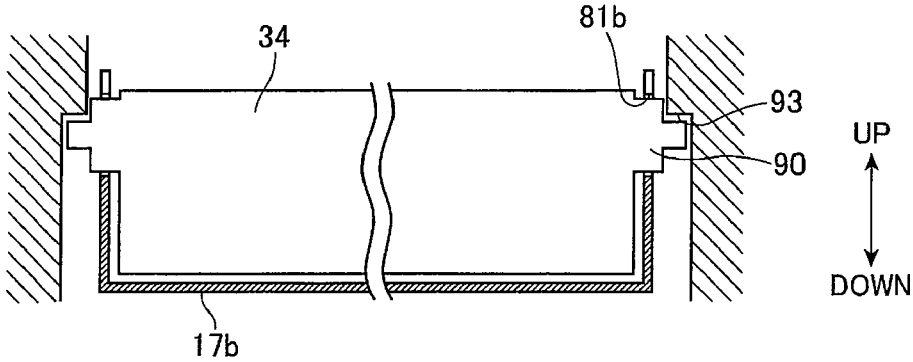
Figure 6C:
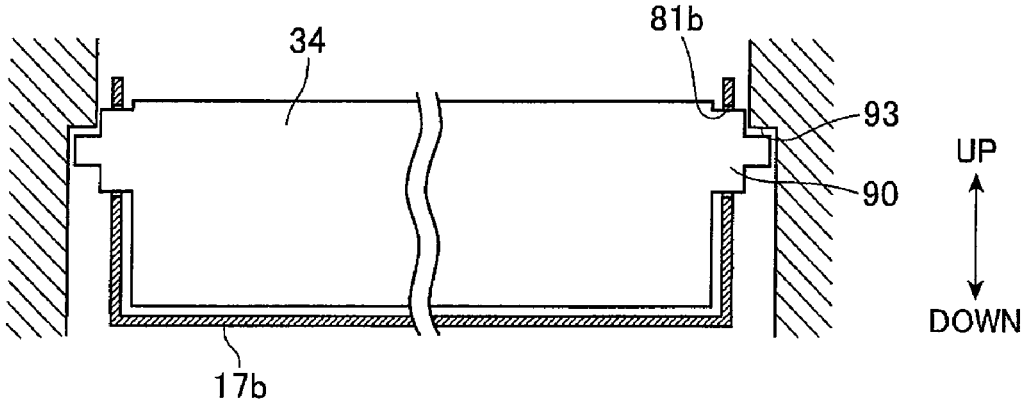
Figure 6D:
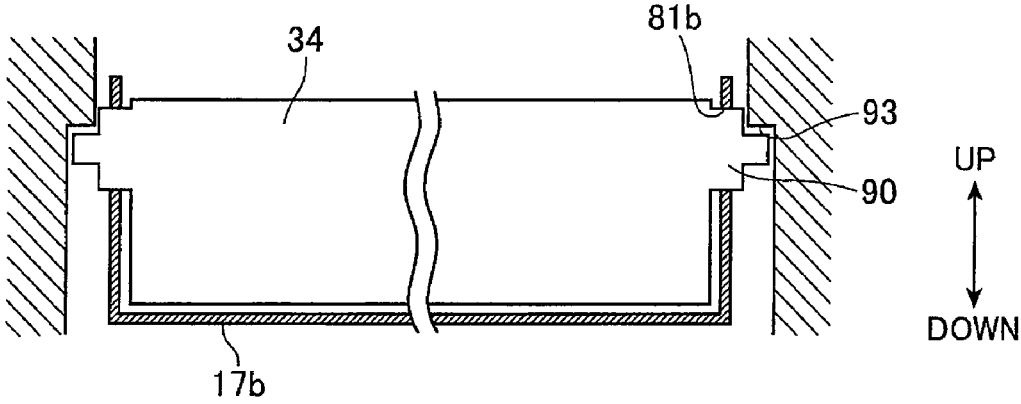
Figure 7A:
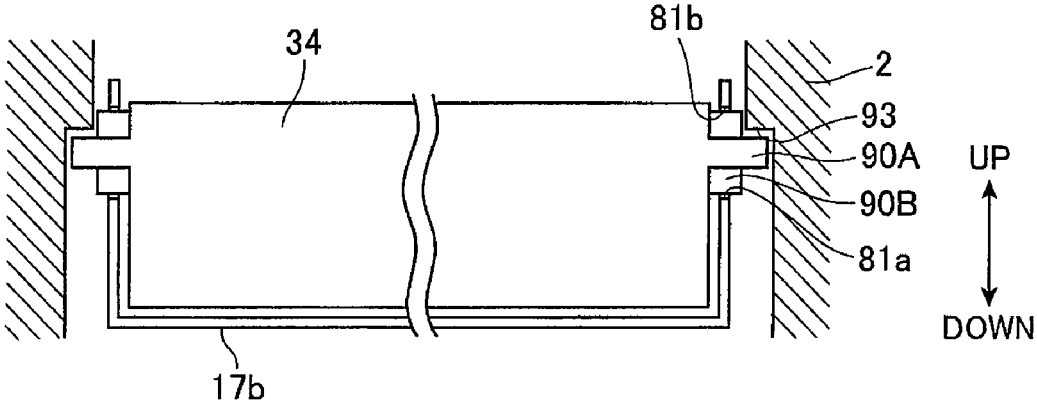
FIG. 7A-7D show a modification of toner unit protrusion, respectively.
Figure 7B:
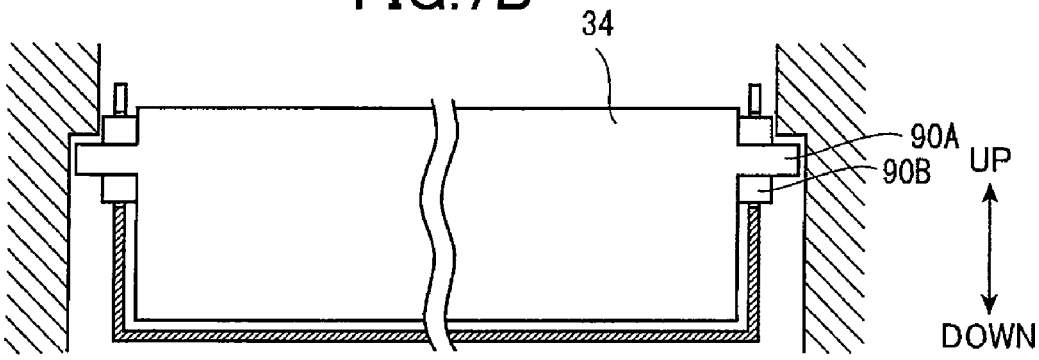
Figure 7C:
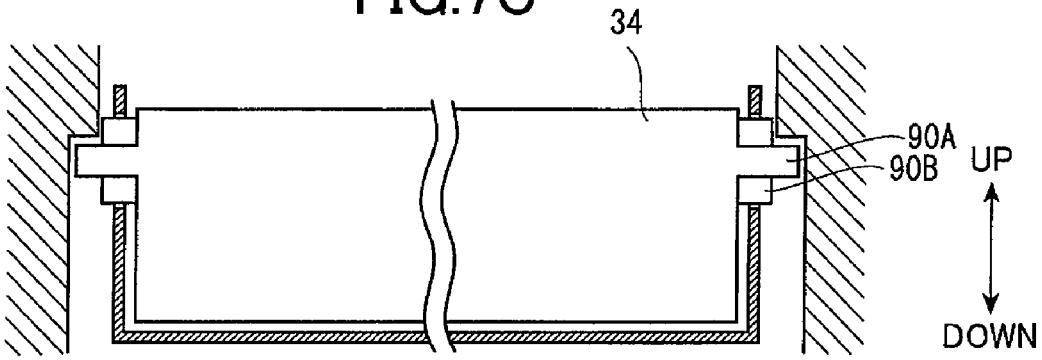
Figure 7D:
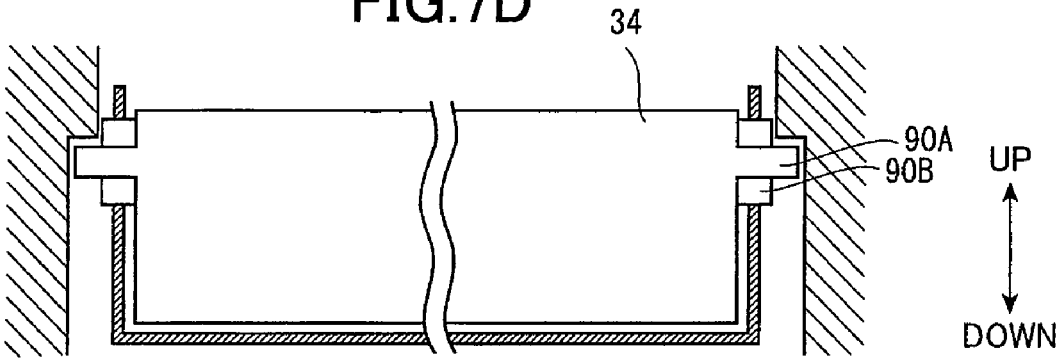

When the toner cartridge 80 is loaded, while guiding the toner cartridge protrusion 90 along the toner cartridge guide 93, and arrives at the position C shown in FIG. 5A, the toner cartridge protrusion 90 is then guided by the toner cartridge guide 81 (FIG. 6B). The toner cartridge protrusion 90 then slides along the guide surface 81*b* of the toner cartridge guide 81 formed in the left and right side plates 17*b* and 17*b* (FIG. 6C). When the toner cartridge protrusion 90 arrives at the trailing end 81*a* of the toner cartridge guide 81, the toner cartridge 80 is supported by the process cartridge 17 with stability (FIG. 6D).

As is clear from FIG. 5A, the toner cartridge guide 81 and the toner cartridge guide 93 have adjacent portions which are parallel to each other. In other words, the guide surface 81*b* of the toner cartridge guide 81 and the portion of the lower guide surface 93*a* of the toner cartridge guide 93 overlap each other over a certain length as viewed from a side in the attaching direction of the toner cartridge 80. In this case, the upper peripheral surface of the toner cartridge projection 90 is guided by the toner cartridge guide 93, and the lower peripheral surface of the toner cartridge projection 90 is guided by the toner cartridge guide 81.

In this embodiment, the toner cartridge projection 90 has a two-level stepped shape. In another embodiment, as shown in FIGS. 7A-7D, the toner cartridge projection 90 may be formed from two separate parts. In other words, the toner cartridge projection 90 may include a small cylinder portion 90A projecting from the side of the toner cartridge 80 to be guided by the toner cartridge guide 93, and a collar 90B coaxially fitted around the small cylinder portion 90A, the collar 90B being to be guided by the toner cartridge guide 81.

In another embodiment, the toner cartridge guide 81 may be aligned with the toner cartridge guide 93 in the loading direction of the toner cartridge 80 In this case, the toner cartridge guide 81 may be connected to the toner cartridge guide 93 without any gap therebetween. Alternatively, the toner cartridge guide 81 may be connected to the toner cartridge guide 93 with a small gap therebetween which is shorter than the diameter of the toner cartridge projection 90.

Alternatively, the process cartridge guide 92 may function as the toner cartridge guide 93. In this case, the process cartridge guide 92 is used for guiding the rotation shaft 27*a* of the photosensitive drum 27 to load the process cartridge 17 to the image forming position. And, the process cartridge guide 92 is used for guiding the toner cartridge protrusion 90 to the toner cartridge guide 81. This structure enables both the process cartridge 17 and the toner cartridge 80 to be attached in the main casing 2 easily. The internal structure of the main casing 2 is formed simple.

In the above embodiments, the rotating shaft 27*a* of the photosensitive drum 27 is used as an engaging portion of the photosensitive member cartridge to the main casing 2. In another embodiment, any type of projection from the side of the photosensitive member cartridge 26 may be used as the engaging portion to the main casing 2.

Similarly, a protrusion member protruding from each side of the developing cartridge 28 may be employed as the engaging portion of the developing cartridge side as well as the roller shaft 31*a* of the developing roller 31.

In addition, a rib protruding upward from the upper surface of the photosensitive member cartridge 26 is formed. And, a photosensitive member cartridge guide for engaging the rib may be provided in the inner upper surface of the internal space 3 of the main casing. Alternatively, a developing cartridge guide may be continuously formed from the starting portion of the internal space of the main casing to the photosensitive member cartridge guide.

Furthermore, a rib protruding downward from the bottom surface of the photosensitive member cartridge 26 is formed. And, a photosensitive member cartridge guide may be formed in the inner bottom surface of the internal space 3 of the main casing 2 to be engaged with the rib. In this case, a developing cartridge guide may be formed extending from the starting portion of the inner bottom surface of the main casing to the photosensitive member cartridge guide of the main casing.

Figure 2B:
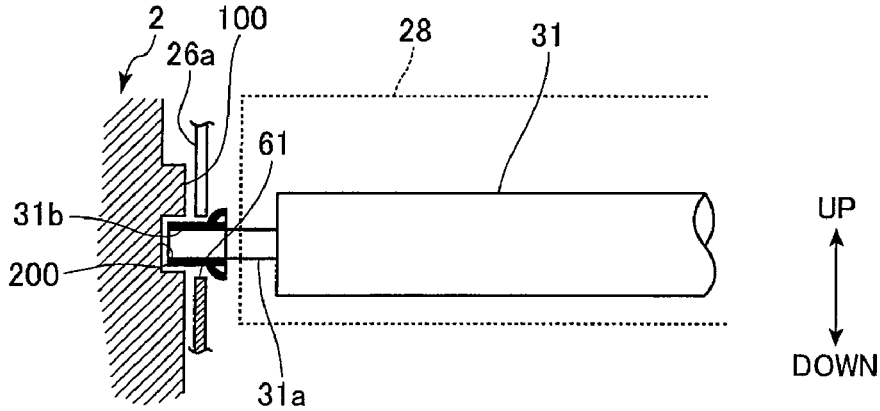
Figure 2C:
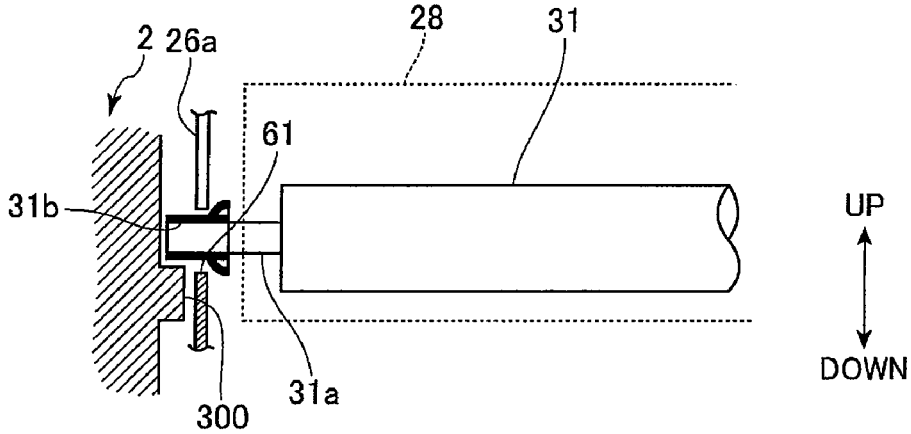
Figure 2D:
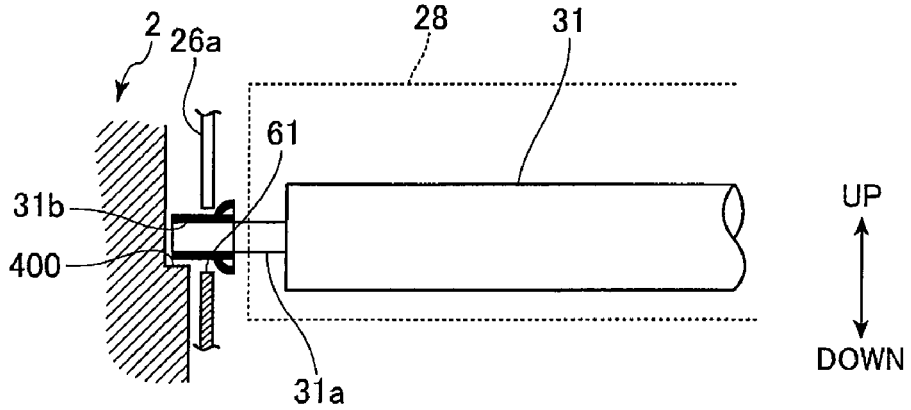

FIGS. 2B through 2D show modifications of the developing cartridge guide 70 according to the first embodiment. As shown in FIG. 2B, a single guide protrusion 100 may be formed on an inner side of the main casing 2 for guiding the upper sliding surface of the outer periphery of the roller shaft 31*a* of the developing roller 31. Further, a guide groove 200 for slidingly contacting the lower sliding surface of the roller shaft 31*a*. As shown in FIG. 2C, a single guide protrusion 300 is formed on an inner side of the main casing 2. The lower sliding surface of the roller shaft 31*a* is guided by the upper guide surface of the guide protrusion 300. As shown in FIG. 2D, a groove is formed in the main casing 2 to provide an upper guide surface 400 for guiding the lower sliding surface of the roller shaft 31*a*. Preferably, the developing cartridge guide has at least a guide surface for guiding the lower sliding surface of the roller shaft 31*a*. In addition, if the upper sliding surface of the roller shaft 31*a* includes a guide surface available to guide the developing cartridge, the developing cartridge 28 is loaded to the main casing 2 smoothly without any unexpected movement.

According to the present invention, the developing cartridge which has been guided by the developing cartridge guide of the main casing is continuously guided by the developing cartridge guide of the photosensitive member cartridge. In other words, the developing cartridge is guided smoothly from the starting portion of the main casing to the photosensitive member cartridge loaded in the main casing. Accordingly, damage to the developing cartridge or the main casing is prevented It is understood that the foregoing description and accompanying drawings set forth the embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. An image forming device comprising:

a main casing having an inner surface;

an image forming portion provided in the main casing to form images;

a first cartridge loadable to and unloadable from the image forming portion; and a second cartridge detachably attachable to the first cartridge, the second cartridge having a side face and a projection projecting from the side face, the side face facing the inner surface when the second cartridge is in the main casing, wherein the first cartridge further comprises a receiving portion for receiving the projection of the second cartridge, and a first guide for guiding the projection of the second cartridge to the receiving portion, and the main casing further comprises a second guide provided in the inner surface for guiding the projection of the second cartridge, the second guide communicating with the first guide of the first cartridge loaded in the image forming portion, to guide the projection of the second cartridge through the second and first guides to the receiving portion, wherein the main casing further comprises a third guide for guiding the first cartridge to the image forming portion.

2. The image forming device according to claim 1, wherein the main casing further comprises an opening communicating with the image forming portion, and the second guide extends between the opening and the first guide of the first cartridge loaded in the image forming portion.

3. The image forming device according to claim 1, wherein the third guide functions as the second guide.

4. The image forming device according to claim 1, wherein the first cartridge comprises a side face and a photosensitive drum having a rotation shaft, the rotation shaft having a projection projecting from the side face of the first cartridge, the projection which projects from the side face of the first cartridge slidable along the third guide to assist with loading the first cartridge.

5. The image forming device according to claim 1, wherein the second cartridge comprises a developing roller having a rotation shaft, the projection is the rotation shaft having an outer peripheral surface with a lower portion, the second guide has an upper surface slidably contacting the lower portion to assist with loading the second cartridge.

6. The image forming device according to claim 1, wherein the first cartridge comprises a side face, a developing roller, and a photosensitive drum having a rotation shaft, the rotation shaft having a projection projecting from the side face of the first cartridge, the projection which projects from the side face of the first cartridge slidable along the third guide to assist with loading the first cartridge.

7. The image forming device according to claim 1, wherein the second cartridge comprises a toner chamber including toner, the projection having an outer peripheral surface with a lower portion, the second guide has an upper surface slidably contacting the lower portion to assist with loading the second cartridge.

8. The image forming device according to claim 1, wherein the second cartridge comprises a guide projection as the projection, a handle, and a toner chamber including toner, the toner chamber having an upper surface, the handle being provided in vicinity of one end of the upper surface, the guide projection provided on an upper portion of the toner chamber at an opposite end of the handle.

9. The image forming device according to claim 1, wherein the second cartridge comprises a guide projection as the projection and a toner chamber including toner, the guide projection projecting from the toner chamber and having a distal end and a proximal end, the distal end having a smaller cross section than the proximal end.

10. The image forming device according to claim 1, wherein the second cartridge is a toner cartridge having a guide projection as the projection, a handle, and a toner chamber including toner, the toner chamber having an upper surface, the handle provided in vicinity of one end of the upper surface, the guide projection provided on an upper portion of the toner chamber at an opposite end of the handle.

11. The image forming device according to claim 1, wherein the second cartridge is a toner cartridge having a guide projection as the projection and a toner chamber including toner, the guide projection projecting from the toner chamber and having a distal end and a proximal end, the distal end having a smaller cross section than the proximal end.

12. The image forming device according to claim 1, wherein the main casing further comprises an opening communicating with the image forming portion, and the second guide of the main casing has a first end portion and a second end portion in a loading direction of the second cartridge to the image forming portion, the first end being closer to the opening than the second end portion, the first guide of the first cartridge has an end portion, and the end portion being positioned near to the second end portion of the second guide when the first cartridge is loaded to the image forming portion.

13. A primary cartridge configured to be loadable to and unloadable from an image forming portion of an image forming device which includes a main casing having a primary guide configured to guide a secondary cartridge to the primary cartridge loaded in the main casing by guiding a projection of the secondary cartridge, comprising:

a receiving portion that receives the projection of a secondary cartridge; and a secondary guide that guides the projection of the secondary cartridge to the receiving portion by the projection, wherein the primary guide is configured to connect with the secondary guide, when the secondary cartridge is loaded in the image forming portion, wherein the primary guide comprises an upper guide surface on which the projection is slidable, and the secondary guide comprises a lower guide surface on which the projection is slidable, the lower guide surface being provided so as to overlap the upper guide surface over a predetermined length from a side view.

14. The primary cartridge according to claim 13, further comprising a photosensitive member.

15. The primary cartridge according to claim 14, wherein the primary cartridge is configured to receive the secondary cartridge which includes a developing roller.

16. A primary cartridge configured to be loadable to and unloadable from an image forming portion of an image forming device which includes a main casing having a primary guide configured to guide a secondary cartridge to the primary cartridge loaded in the main casing by guiding a projection of the secondary cartridge, comprising:

a receiving portion that receives the projection of a secondary cartridge; and a secondary guide that guides the projection of the secondary cartridge to the receiving portion by the projection, wherein the primary guide is configured to connect with the secondary guide, when the secondary cartridge is loaded in the image forming portion, wherein the projection has a length in a loading direction of the secondary cartridge, the primary guide comprises an upper guide surface on which the projection is slidable, and the secondary guide comprises a lower guide surface on which the projection is slidable, the lower guide surface being aligned with the upper guide surface through a gap therebetween, the gap being smaller than the length in the loading direction.

17. A secondary cartridge detachably attachable to a primary cartridge loaded in an image forming portion in a main casing of an image forming device, the primary cartridge comprising a primary guide for guiding the secondary cartridge, the main casing comprising a secondary guide for guiding the secondary cartridge, comprising:

a casing having a side face; and a single projection formed in an upper portion of the side face, the projection being configured to be guided by and in contact with the secondary guide and the primary guide in series to a predetermined position in the image forming portion.

18. The secondary cartridge according to claim 17, wherein the projection has a length in a loading direction thereof to the predetermined position, the length being larger than a distance between the primary guide and the secondary guide.

* * * * *